US012268241B2

(12) United States Patent
Brookbank

(10) Patent No.: US 12,268,241 B2
(45) Date of Patent: Apr. 8, 2025

(54) AEROSOL GENERATION

(71) Applicant: NICOVENTURES TRADING LIMITED, London (GB)

(72) Inventor: Aaron Brookbank, London (GB)

(73) Assignee: NICOVENTURES TRADING LIMITED, London (GB)

( * ) Notice: Subject to any disclaimer, the term of this patent is extended or adjusted under 35 U.S.C. 154(b) by 439 days.

(21) Appl. No.: 17/595,954

(22) PCT Filed: May 29, 2020

(86) PCT No.: PCT/EP2020/064999

§ 371 (c)(1),
(2) Date: Nov. 30, 2021

(87) PCT Pub. No.: WO2020/239987

PCT Pub. Date: Dec. 3, 2020

(65) Prior Publication Data

US 2022/0151297 A1 May 19, 2022

(30) Foreign Application Priority Data

May 30, 2019 (GB) ..... 1907702

(51) Int. Cl.
*A24F 40/46* (2020.01)
*A24F 40/20* (2020.01)
(Continued)

(52) U.S. Cl.
CPC ..... *A24F 40/46* (2020.01); *A24F 40/20* (2020.01); *A24F 40/30* (2020.01); *A24F 40/57* (2020.01); *A24F 40/60* (2020.01)

(58) Field of Classification Search
CPC ..... A24F 40/46; A24F 40/20; A24F 40/30; A24F 40/57; A24F 40/60; A24F 40/40;
(Continued)

(56) References Cited

U.S. PATENT DOCUMENTS 8,061,361 B2 * 11/2011 Maeder ..... A24D 1/22 131/194
8,678,013 B2 * 3/2014 Crooks ..... A24B 15/165 131/273
(Continued)

FOREIGN PATENT DOCUMENTS

CN 207100508 U 3/2018
EP 2753202 A1 7/2014
(Continued)

OTHER PUBLICATIONS

"International Preliminary Report on Patentability received for PCT Patent Application No. PCT/EP2020/064999, mailed on Dec. 9, 2021", 14 pages.
(Continued)

*Primary Examiner* — Alexander Gilman
(74) *Attorney, Agent, or Firm* — Husch Blackwell

(57) ABSTRACT

Disclosed herein is an aerosol generating system an aerosolizable material, wherein the aerosolizable material includes at least two sections, wherein at least one of the sections includes a tobacco material; at least first and second heaters, wherein the heaters are arranged to respectively heat the different sections of the aerosolizable material, wherein the system is configured such that during a session of use, after initiation of heating of a first of the sections by the first heater, the second heater is selectively actuatable to heat a second of the sections to a temperature which causes volatilization of aerosolizable components of the second section.

46 Claims, 7 Drawing Sheets

(51) Int. Cl.
*A24F 40/30* (2020.01)
*A24F 40/57* (2020.01)
*A24F 40/60* (2020.01)

(58) Field of Classification Search
CPC . A24F 40/50; A24F 7/00; A24F 40/42; A24D 1/20; A24D 1/002; A24D 1/045; A24B 13/00; A24B 15/16; A24B 15/186; A24B 15/34
USPC ..... 131/329
See application file for complete search history.

(56) References Cited

U.S. PATENT DOCUMENTS

| | | | | |
|---|---|---|---|---|
| 11,141,548 | B2 * | 10/2021 | Ballesteros Gomez | A61M 11/042 |
| 2014/0182608 | A1 * | 7/2014 | Egoyants | A61M 15/0091 131/328 |
| 2014/0311508 | A1 * | 10/2014 | Besso | A24D 1/02 131/108 |
| 2017/0119050 | A1 * | 5/2017 | Blandino | A24B 15/16 |
| 2017/0164657 | A1 * | 6/2017 | Batista | A24F 40/42 |
| 2017/0231276 | A1 * | 8/2017 | Mironov | H05B 1/0244 131/328 |
| 2017/0232211 | A1 * | 8/2017 | Gallem | A61M 15/0005 128/203.12 |
| 2018/0035719 | A1 * | 2/2018 | Turner | A24F 40/30 |
| 2018/0168224 | A1 * | 6/2018 | Naughton | A24F 40/85 |
| 2018/0352856 | A1 * | 12/2018 | Sebastian | A24F 40/44 |
| 2019/0116874 | A1 * | 4/2019 | England | A24D 3/10 |
| 2019/0166918 | A1 * | 6/2019 | Thorsen | A61M 16/109 |
| 2019/0208815 | A1 * | 7/2019 | Thorsen | A24F 40/46 |
| 2019/0208816 | A1 * | 7/2019 | Thorsen | H05B 3/40 |
| 2019/0208817 | A1 * | 7/2019 | Qiu | A24F 40/485 |
| 2019/0274354 | A1 * | 9/2019 | Sur | H05B 1/0244 |
| 2019/0387799 | A1 * | 12/2019 | Reevell | A24F 40/30 |
| 2020/0345960 | A1 * | 11/2020 | Begin | A24F 40/40 |
| 2021/0051993 | A1 * | 2/2021 | Kim | A24F 40/20 |
| 2021/0068460 | A1 * | 3/2021 | Egoyants | A24F 40/46 |

FOREIGN PATENT DOCUMENTS

| | | | |
|---|---|---|---|
| EP | 2753202 | B1 | 4/2016 |
| JP | 2018512142 | A | 5/2018 |
| JP | 2018527889 | A | 9/2018 |
| UA | 112456 | C2 | 9/2016 |
| UA | 126436 | C2 | 10/2022 |
| UA | 126944 | C2 | 2/2023 |
| WO | 2013098409 | A1 | 7/2013 |
| WO | 2013152873 | A1 | 10/2013 |
| WO | 2015091258 | A1 | 6/2015 |
| WO | WO2015166245 | A2 | 11/2015 |
| WO | 2016156510 | A2 | 10/2016 |
| WO | 2017029268 | A1 | 2/2017 |
| WO | 2017144861 | A1 | 8/2017 |
| WO | 2017186946 | A1 | 11/2017 |
| WO | 2017198838 | A1 | 11/2017 |
| WO | 2017198876 | A1 | 11/2017 |
| WO | WO-2017198837 | A1 | 11/2017 |
| WO | WO2018019855 | A1 | 2/2018 |
| WO | WO-2019105750 | A1 | 6/2019 |
| WO | WO-2019224366 | A1 | 11/2019 |

OTHER PUBLICATIONS

"Office Action received for Australian Patent Application No. 2020281950, mailed on Apr. 13, 2023", 6 pages.
"Office Action received for Australian Patent Application No. 2020281950, mailed on Jan. 11, 2023", 5 pages.
"Office Action received for Russian Patent Application No. 2021138453, mailed on Jun. 15, 2022", 9 pages.
"Office Action received for Ukrainian Patent Application No. a202106913, mailed on Mar. 13, 2023", 5 pages (Official Copy Only).
"Office Action received for Ukrainian Patent Application No. a202106913, mailed on May 23, 2023", 4 pages (Official Copy Only).
International Search Report and Written Opinion for Application No. PCT/EP2020/064999, mailed on Sep. 15, 2020, 20 pages.

* cited by examiner

AEROSOL GENERATION

PRIORITY CLAIM

The present application is a National Phase entry of PCT Application No. PCT/EP2020/064999, filed May 29, 2020, which claims priority from GB Patent Application No. 1907702.3, filed May 30, 2019, each of which is hereby fully incorporated herein by reference.

TECHNICAL FIELD

The present disclosure relates to aerosol generation and particularly, although not exclusively, to an aerosol generating system and an aerosol generating article for use in an aerosol generating system.

BACKGROUND

Smoking articles such as cigarettes, cigars and the like burn tobacco during use to create tobacco smoke. Alternatives to these types of articles release compounds without burning.

Apparatuses are known that heat aerosolizable material to volatilize at least one component of the aerosolizable material, typically to form an aerosol which can be inhaled, without burning or combusting the aerosolizable material. Such an apparatus is sometimes described as a "heat-not-burn" apparatus or a "tobacco heating product" (THP) or "tobacco heating device" or similar. Various different arrangements for volatilizing at least one component of the aerosolizable material are known.

The material may be for example tobacco or other non-tobacco products or a combination, such as a blended mix, which may or may not contain nicotine.

SUMMARY

According to a first aspect of the present disclosure, there is provided an aerosol generating system comprising: an aerosolizable material, wherein the aerosolizable material comprises at least two sections, wherein at least one of the sections comprises a tobacco material; at least first and second heaters, wherein the heaters are arranged to respectively heat the different sections of the aerosolizable material, wherein the system is configured such that during a session of use, after initiation of heating of a first of the sections by the first heater, the second heater is selectively actuatable to heat a second of the sections to a temperature which causes volatilization of aerosolizable components of the second section.

The provision of a selectively operable second heater allows the user to control volatilization of components of the second section, facilitating user control over the composition of the generated aerosol.

According to a second aspect of the disclosure, there is provided an aerosol generating article for use in a system according to the first aspect. In some embodiments, this provides aerosol generating article for use in an aerosol generating system, the article comprising aerosolizable material and a cooling element and/or a filter, wherein the aerosolizable material comprises at least two sections having different compositions, wherein at least one of the sections comprises a tobacco material and at least the other of the sections comprises an aerosol modifying agent A third aspect of the disclosure provides an aerosol generating device comprising at least first and second heaters, wherein the heaters are arranged to respectively heat first and second sections of an aerosolizable material in use, wherein the device is configured such that during a session of use, after initiation of heating the first heater to a temperature which causes volatilization of aerosolizable components of the first section of aerosolizable material, the second heater is selectively actuatable to heat a second of the sections to a temperature which causes volatilization of aerosolizable components of the second section of aerosolizable material.

Features disclosed herein in relation to the aerosol generating article are hereby explicitly disclosed in combination with the aerosol generating system of the first aspect. Features disclosed herein in relation to the aerosol generating system are hereby explicitly disclosed in combination with the aerosol generating device of the third aspect.

BRIEF DESCRIPTION OF THE DRAWINGS

Further features and advantages of the disclosure will become apparent from the following description of examples of the disclosure, given by way of example only, which is made with reference to the accompanying drawings.

DETAILED DESCRIPTION

Figure 1:
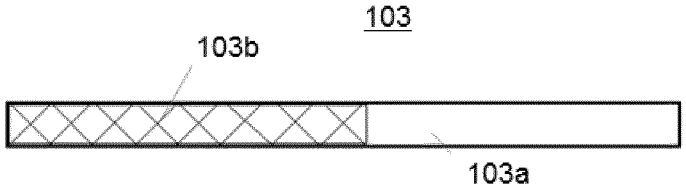
FIG. 1 is a schematic view of an aerosolizable material for use in an aerosol generating system.

The aerosol generating system according to examples of the disclosure may also be referred to herein as a heat not burn device, a tobacco heating product or a tobacco heating device.

As noted above, the disclosure provides an aerosol generating system comprising: an aerosolizable material, wherein the aerosolizable material comprises at least two sections, wherein at least one of the sections comprises a tobacco material; and at least first and second heaters, wherein the heaters are arranged to respectively heat the different sections of the aerosolizable material, wherein the system is configured such that during a session of use, after initiation of heating of a first section by the first heater, the second heater is selectively actuatable to heat a second section to a temperature which causes volatilization of aerosolizable components of the second section.

In some cases, at least the other of the sections comprises an aerosol modifying agent.

In some cases, the disclosure provides an aerosol generating system comprising: an aerosolizable material, wherein the aerosolizable material comprises at least two sections, wherein a first section comprises a tobacco material and a second section comprises an aerosol modifying agent; and at least first and second heaters, wherein the heaters are arranged to respectively heat the different sections of the aerosolizable material, wherein the system is configured such that after initiation of heating of the first section by the first heater, the second heater is selectively actuatable to heat the second section to a temperature which causes volatilization of aerosolizable components of the second section.

In some cases, the system is configured such that after initiation of and prior to conclusion of the heating of the first section, the second heater is selectively actuatable to heat the second section to a temperature which causes volatilization of aerosolizable components of the second section. In some cases, the system is configured such that during heating of the first section by the first heater, the second heater is selectively actuatable to heat the second section to a temperature which causes volatilization of aerosolizable components of the second section.

In some cases, the two sections of aerosolizable material are solid or in gel form.

In some cases, the two sections of aerosolizable material have different compositions.

The first section may comprise the tobacco material. In some cases, the first section of the aerosolizable material may additionally include one or more aerosol generating agents, flavorants, binders and/or fillers.

The second section may comprise the aerosol modifying agent. The aerosol modifying agent may be any compound which can be aerosolized and combined with the aerosol generated by heating the first section, and which changes how the aerosol is perceived by the user. In some embodiments, the aerosol modifying agent may comprise aerosol generating agents, flavorants, aromas and stimulants. In some embodiments, the aerosol modifying agent comprises one or more flavorants, suitably menthol. In some cases, the aerosol modifying agent essentially consists of, or consists of, menthol.

In some cases, the section comprising the aerosol modifying agent may comprise the aerosol modifying agent in an amount of 0.1 wt % to 99 wt % by weight of the second section, suitably 1-98 wt %, 5-95 wt %, 10-90 wt %, 20-75 wt % or 30-55 wt %.

In some cases, the aerosolizable components of the other of the sections are stabilized, so that they do not transfer into the aerosol unless the second heater is actuated by the user.

In some cases, the aerosol modifying agent may be encapsulated, wherein the aerosol modifying agent is releasable on heating of the appropriate section to a threshold release temperature. Encapsulation can be used to prevent unintended volatilization of the aerosol modifying agent resulting from heat bleed from the first section. Encapsulation also serves to prevent migration of the aerosol modifying agent within the aerosolizable material before use.

In some cases, the threshold release temperature is at least 50° C., optionally at least 100° C., optionally at least 150° C., and optionally less than about 300° C., about 270° C. or about 250° C.

The aerosol modifying agent may be encapsulated in an encapsulating material. In some cases, the encapsulating material comprises at least one of a polysaccharide material such as an alginate, carrageenan or pectin material; a cellulosic material; a gelatin; a gum; a protein material; a polyol matrix material; a gel; a wax; a polyurethane; polymerized, hydrolyzed ethylene vinyl acetate, a polyester, a polycarbonate, a polymethacrylate, a polyglycol, polyethylene, polystyrene, polypropylene, polyvinyl chloride or a mixture thereof or a mixture thereof.

In some cases, the temperature dependent release may be provided through use of an encapsulating material that that melts, decomposes, reacts, degrades, swells or deforms to release the flavorant at the release temperature. In other cases, heating may cause the encapsulated aerosol modifying agent to swell causing rupture of the encapsulating material.

Encapsulated aerosol modifying agent may be provided in the form of capsules that are powders, granules or beads. In some cases, these capsules may be carrier on a substrate, such as the wrapper surrounding the aerosol generating article. In some cases, the encapsulated aerosol modifying agent may be provided in the form of an amorphous solid which encapsulates the aerosol modifying agent. The amorphous solid may comprise a polysaccharide matrix. The amorphous solid may be provided as a thin film. This thin film may be provided in shredded or sheet form, for example. In some cases, the encapsulated aerosol modifying agent may be present in a mixture of these forms, such as a combination of capsules and an encapsulating film.

In some cases, the section which includes an encapsulated aerosol modifying agent may additionally comprise an un-encapsulated aerosol modifying agent. For example, in some cases the section comprising the aerosol modifying agent may include an encapsulated flavorant such as menthol, and additionally comprise an un-encapsulated flavorant, such as menthol.

In some cases, the aerosolizable material may be provided as part of an aerosol generating article which is inserted into the heater in use. Such articles for another aspect of the invention, as set out above. Discussion herein in relation to the article is explicitly disclosed in combination with the system aspect of the invention also.

In the second aspect of the disclosure, the aerosol generating article for use in an aerosol generating system comprises an aerosolizable material and a cooling element and/or a filter, wherein the aerosolizable material comprises at least two sections having different compositions, wherein a first section of the sections comprises a tobacco material and a second section of the sections comprises an aerosol modifying agent.

In some cases, the aerosol generating article for use in an aerosol generating system comprises an aerosolizable material and a cooling element and/or a filter, wherein the aerosolizable material comprises at least two sections having different compositions, wherein a first section comprises a tobacco material and a second section comprises an aerosol modifying agent.

In some cases, the second section of the aerosolizable material is provided between the first section of the aerosolizable material and the cooling element and/or filter. In other cases, the first section of the aerosolizable material is provided between the second section of the aerosolizable material and the cooling element and/or filter.

In some cases, the first section and/or the second section comprises an un-encapsulated aerosol modifying agent. In some cases, the first section and/or the second section the article does not include any un-encapsulated aerosol modifying agent. In some cases, the article does not include any un-encapsulated aerosol modifying agent.

In some cases, the other of the sections of the of aerosolizable material, suitably the second section, does not include any tobacco material.

In some cases where the aerosol modifying agent is included in the second section, the first section of the aerosolizable material does not include any aerosol modifying agent of the same type as present in the second section. By this, it is meant that the aerosol modifying agent in the second section is not present in the same format in the first section. Thus, in these embodiments, for example, encapsulated menthol may be provided in the second section and not in the first section, whilst unencapsulated menthol might be provided in either or both sections. The menthol present in the second section is encapsulated, and that encapsulated format is not seen in the first section.

In some cases, an aerosol generating article is provided in which;

- a filter and/or cooling element are provided at the mouth end,
- the second section of aerosolizable material comprises encapsulated flavorant and no tobacco material,
- the first section of aerosolizable material comprises tobacco material but no encapsulated flavorant.

Suitably, the second section is provided adjacent to the filter and/or cooling element, and the first section provided adjacent to the first section (opposite to the filter and/or cooling element). That is, the second section may suitably be disposed between the second section and the filter/cooling element.

Suitably, neither, either or both sections may comprise un-encapsulated flavorant.

In some cases, the aerosolizable material has a rod shape. As used herein, the term "rod" generally refers to an elongate body which may be any suitable shape for use in an aerosol generating system. In some cases, the rod is substantially cylindrical, and the at least two sections are arranged coaxially along the longitudinal axis of the rod of aerosolizable material. The sections may be cylindrical in some cases. In some cases, the sections may each have the same dimensions. In other cases, the sections may have different dimensions. In some cases, the cylindrical sections may have a cross-sectional diameter of approximately 5-9 mm, suitably 7.5-8 mm. In some cases, the total length of the rod may be about 30-54 mm, suitably 36-48 mm. In some cases, the rod may comprise two sections, each having a length of about 15-27 mm, suitably 18-24 mm. In some cases, the rod may comprise two sections, each having a length of about 15-20 mm, suitably about 18 mm. In some cases, the rod may comprise two sections, each having a length of about 22-27 mm, suitably about 24 mm.

In other cases, the sections of the aerosolizable material may be in the form of prismatic sections that are arranged to together form a rod such as a cylinder. For example, in the case where there are two sections, they may be hemicylindrical and arranged with their respective planar faces in contact.

The cooling element, if present, may act or function to cool gaseous or aerosol components. In some cases, it may act to cool gaseous components such that they condense to form an aerosol. It may also act to space the very hot parts of the apparatus from the user. The filter, if present, may comprise any suitable filter known in the art such as a cellulose acetate plug. The aerosol generating article may be circumscribed by a wrapping material such as paper.

The aerosol generating article may additionally comprise ventilation apertures. These may be provided in the sidewall of the article. In some cases, the ventilation apertures may be provided in the filter and/or cooling element. These apertures may allow cool air to be drawn into the article during use, which can mix with the heated volatilized components thereby cooling the aerosol.

The ventilation enhances the generation of visible heated volatilized components from the article when it is heated in use. The heated volatilized components are made visible by the process of cooling the heated volatilized components such that supersaturation of the heated volatilized components occurs. The heated volatilized components then undergo droplet formation, otherwise known as nucleation, and eventually the size of the aerosol particles of the heated volatilized components increases by further condensation of the heated volatilized components and by coagulation of newly formed droplets from the heated volatilized components.

In some cases, the ratio of the cool air to the sum of the heated volatilized components and the cool air, known as the ventilation ratio, is at least 15%. A ventilation ratio of 15% enables the heated volatilized components to be made visible by the method described above. The visibility of the heated volatilized components enables the user to identify that the volatilized components have been generated and adds to the sensory experience of the smoking experience.

In another example, the ventilation ratio is between 50% and 85% to provide additional cooling to the heated volatilized components. In some cases, the ventilation ratio may be at least 60% or 65%.

The aerosolizable material is heated in the system to generate an aerosol without burning the material.

In some cases, each heater provided in the aerosol generating system may be a thin film, electrically resistive heater. In other cases, each heater may comprise an induction heater or the like. For the avoidance of doubt, the first and second heaters may be the same as each other or different from each other.

Generally, each heater is connected to a battery, which may be a rechargeable battery or a non-rechargeable battery. Examples of suitable batteries include for example a lithium-ion battery, a nickel battery (such as a nickel-cadmium battery), an alkaline battery and/or the like. The battery is electrically coupled to the heater and is controllable via appropriate circuitry to supply electrical power when required to heat the aerosolizable material (to volatilize components of the aerosolizable material without causing the aerosolizable material to burn).

In one example, the heaters are generally in the form of hollow cylindrical tubes, coaxially disposed and having a hollow interior heating chamber into which the aerosolizable material is inserted for heating in use. The ends of the respective tubes may be in abutment. The heaters may be dimensioned so that substantially the whole of the aerosolizable material is heated in use.

In other example, the heaters may be in the form of one or more blades which are inserted into the aerosolizable material in use. The heaters may be provided as a single blade with independently heatable regions, for example.

Each heater may be surrounded along at least part of its length by a thermal insulator which helps to reduce heat passing from the heater to the exterior of the aerosol generating system. This helps to keep down the power requirements for the heater as it reduces heat losses generally. The insulator also helps to keep the exterior of the aerosol generating system cool during operation of the heater.

In some cases, the first heater may be heated to at least 180° C., 200° C., 220° C. or 240° C. to volatilize components of the first section of aerosolizable material. In some cases, the assembly may be configured such that at least a portion of the aerosolizable material is exposed to a temperature of at least 180° C., 200° C., 220° C. or 240° C. for at least 50% of the heating period. In some cases, the first heater may be puff actuated.

In some cases, the aerosol generating system may comprise a memory with a library of stored heating profiles, and wherein the heating profile applied by the system may be dependent on the composition of the aerosol generating material, which composition may be detected by the system. For example, the aerosol generating material may include a unique identifier, such as a bar code, RFID or the like, which identifies the composition and which is detected by the system, which then selects an appropriate heating profile from the library of stored profiles.

As noted above, the system is configured such that after initiation of heating of the first section by the first heater, the second heater is selectively actuatable by the user to heat the second section to a temperature which causes volatilization of aerosolizable components of the second section of aerosolizable material.

In some cases, the system comprises a user input mechanism, operable by a user in use to cause actuation of the second heater. In some cases, the second heater may be actuated by a button. In some cases, once the second heater is actuated, it heats the second section until the end of the aerosolization session. In other cases, the second heater may be actuated intermittently during the session to release the aerosol modifying agent intermittently. For example, in some cases, the button is pressed to initiate heating of the second heater for a predetermined period of time (thereby releasing a predetermined volume of the aerosol modifying agent). As another example, in some cases, the button must be pressed and held to actuate the second heater, wherein the heater deactivates when the button is released (such that the aerosol modifying agent is volatilized for a period substantially corresponding to the time when the button is held).

In some cases, the second heater is configured such that during a period when the second heater is not actuated to heat the second section to a temperature which volatilizes components thereof, the second heater is at (i.e. heated to) an intermediate temperature, wherein the intermediate temperature is higher than room temperature and lower than a temperature required to volatilize components of the second section. This means that the second heater can rapidly reach the volatilization temperature on actuation.

In some cases, there may be more than two sections of aerosolizable material. For example, in some cases, there may be a third section of aerosolizable material and a third heater which heats this section. In some such cases, the first section may comprise tobacco material, the second section may comprise the aerosol modifying agent, and the third section may comprise tobacco material. In some such cases, the third section is adjacent to the first section, and may abut the first section. In some cases, the first and third sections have the same composition. In some cases, the first and third sections have different compositions.

In some such cases, the assembly is configured to provide a different heat profile to each of the first and third sections of aerosolizable material. Through applying different heat profiles to the first and third sections, it is possible to control the puff profile of the aerosol during use. The heat provided to the two portions of the aerosolizable material may be provided at different times or rates; staggering the heating in this way may allow for both fast aerosol production and longevity of use.

In some cases, the aerosol generating system comprises at least a third heater. In some such cases, the third heater is configured to heat the same section of aerosolizable material as the first section. In other cases, the third heater is configured to heat a third section of the aerosolizable material. In each case, the heating profile of the third heater is programmed into the system and is not selectively actuatable by the user.

In some such cases, the assembly may be configured such that on initiation of the consumption experience, a first heater corresponding to a first section of the aerosolizable material is immediately heated to a volatilization temperature which effects volatilization of the aerosolizable components. After a set period of time, the first heating element temperature drops to an intermediate temperature, which is selected to prevent condensation of the aerosol in the first section.

Either on initiation of the consumption experience or after period of time, a third heater corresponding to a third section of the aerosolizable material is heated to an intermediate temperature (which may be the same or different to the first heater's intermediate temperature). After a set period of time, the third heating element is heated to a volatilization temperature (which may be the same or different to the first heater's volatilization temperature). Typically, at least one of the first and third heaters is at its volatilization temperature throughout the consumption experience, and in some cases, both of the first and third heating elements are at their volatilization temperature simultaneously, for a period of time. The third heater's intermediate temperature is selected so that the third section can be heated to its volatilization temperature quickly.

At the end of the consumption experience, both heaters are allowed to cool to room temperature.

A further aspect of the invention provides an aerosol generating device comprising at least first and second heaters, wherein the heaters are arranged to respectively heat first and second sections of an aerosolizable material in use, wherein the device is configured such that during a session of use, after initiation of heating the first heater to a temperature which causes volatilization of aerosolizable components of the first section of aerosolizable material, the second heater is selectively actuatable to heat a second of the sections to a temperature which causes volatilization of aerosolizable components of the second section of aerosolizable material.

In some cases, the aerosol generating device is a device which, together with an aerosolizable material, forms the aerosol generating assembly described herein. Features discussed in relation to the assembly (and which do not relate to the aerosolizable material) are hereby explicitly disclosed in combination with the device aspect of the disclosure, to the extent that they are compatible.

To the extent that they are compatible, features described in relation to one aspect of the invention are explicitly disclosed in combination with the other aspects and examples described herein.

As used herein, the term "tobacco material" refers to any material comprising tobacco or derivatives thereof. The term "tobacco material" may include one or more of tobacco, tobacco derivatives, expanded tobacco, reconstituted tobacco or tobacco substitutes. The tobacco material may comprise one or more of ground tobacco, tobacco fiber, cut tobacco, extruded tobacco, tobacco stem, reconstituted tobacco and/or tobacco extract.

The tobacco used to produce tobacco material may be any suitable tobacco, such as single grades or blends, cut rag or whole leaf, including Virginia and/or Burley and/or Oriental. It may also be tobacco particle 'fines' or dust, expanded tobacco, stems, expanded stems, and other processed stem materials, such as cut rolled stems. The tobacco material may be a ground tobacco or a reconstituted tobacco material. The reconstituted tobacco material may comprise tobacco fibers, and may be formed by casting, a Fourdrinier-based paper making-type approach with back addition of tobacco extract, or by extrusion.

As used herein, an "aerosol generating agent" is an agent that promotes the generation of an aerosol on heating. An aerosol generating agent may promote the generation of an aerosol by promoting an initial vaporization and/or the condensation of a gas to an inhalable solid and/or liquid aerosol. Suitable aerosol generating agents include, but are not limited to: a polyol such as sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate.

As used herein, the terms "flavor" and "flavorant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder. In some embodiments, the sensorial receptor site activator or stimulator is a sensate, such as a cooling agent. Suitable cooling agents may comprise one or more compounds selected from the group consisting of: N-ethyl-2-isopropyl-5-methylcyclohexane carboxamide (also known as WS-3, CAS: 39711-79-0, FEMA: 3455); 2-isopropyl-N-[(ethoxycarbonyl)methyl]-5-methylcyclohexanecarboxamide (also known as WS-5, CAS: 68489-14-5, FEMA: 4309); 2-isopropyl-N-(4-methoxylphenyl)-5-methylcyclohexanecarboxamide (also known as WS-12, FEMA: 4681); and 2-isopropyl-N,2,3-trimethylbutanamide (also known as WS-23, FEMA: 3804).

As used herein, the term "stimulant" includes nicotine and caffeine, and other compounds which stimulate the body.

As used herein, the term "binder" includes compounds which may be included in the aerosol generating material to increase its toughness or strength. Suitable compounds include alginate salts comprising any suitable cation; celluloses or modified celluloses, such as hydroxypropyl cellulose and carboxymethylcellulose; starches or modified starches; polysaccharides such as pectin salts comprising any suitable cation, such as sodium, potassium, calcium or magnesium pectate; xanthan gum, guar gum, and any other suitable natural gums; and mixtures thereof. In some embodiments, the binder comprises, substantially consists of or consists of one or more alginate salts selected from sodium alginate, calcium alginate, potassium alginate or ammonium alginate.

As used herein, the term "filler" includes organic and inorganic filler materials. The filler material may be selected to have one or more purposes. In some embodiments, it may act as a sorbent and/or support for other substances in the aerosol generating material. In some embodiments, it may act as a structure for adsorbing other substances before releasing them on heating. In some embodiments, it may act as a sorbent and/or support for an aerosol generating agent, such as glycerol, and/or any other substances that influence the sensory characteristics of the aerosol generated on heating. Suitable organic filler material include, but are not limited to: wood pulp, cellulose and cellulose derivatives. Suitable inorganic filler materials include, but are not limited to: calcium carbonate, perlite, vermiculite, diatomaceous earth, colloidal silica, magnesium oxide, magnesium sulphate, magnesium carbonate, and suitable inorganic sorbents, such as molecular sieves.

Further embodiments of the disclosure will now be described with reference to the figures.

FIG. 1 illustrates schematically an example of an aerosolizable material for use with an aerosol generating system. The aerosolizable material is in the form of a cylindrical rod and comprises a first section 103*a* and a second section 103*b*. The second section 103*b* is, in this example, further from the mouth in use than the first section 103*a*.

The first section 103*a* includes a tobacco material and no encapsulated flavorant. The second section 103*b* include encapsulated flavorant and no tobacco material. Optionally, neither, either or both sections may include unencapsulated flavorant, which, if present, may be the same flavorant or a different flavorant to that encapsulated in the second section 103*b*. Suitably, the encapsulated flavorant may comprise menthol.

Figure 2:
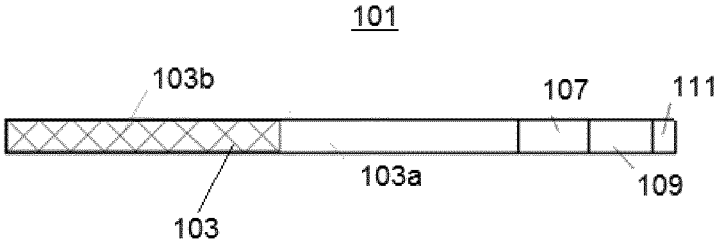
FIG. 2 is a schematic view of an aerosol generating article comprising an aerosolizable material for use in an aerosol generating system.

FIG. 2 illustrates schematically an example of an aerosol generating article 101 for use with an aerosol generating system. The aerosol generating article 101 includes, the cylindrical rod of aerosolizable material 103 illustrated in FIG. 1, a cooling element 107, a filter 109 and a mouth-end segment 111. The cooling element 107 and filter 109, as illustrated, may be arranged between the mouth-end of the aerosolizable material 103 and the mouth-end segment 111, so that flow from the aerosolizable material 103 passes through the cooling element 107 and filter 109 (or vice versa if the filter is arranged before the cooling element in the flow) before reaching the user. Although the example in FIG. 2 illustrates a cooling element 107, a filter 109 and a mouth-end segment 111, one or more of these elements may be omitted in other examples.

In some examples, the mouth-end segment, if present, 111 may be formed of for example paper, for example in the form of a spirally wound paper tube, cellulose acetate, cardboard, crimped paper, such as crimped heat resistant paper or crimped parchment paper, and/or polymeric materials, such as low density polyethylene (LDPE), or some other suitable material. The mouth-end segment 111 may comprise a hollow tube. Such a hollow tube may provide a filtering function to filter volatilized aerosolizable material. The mouth-end segment 111 may be elongate, in order to be spaced from the very hot part(s) of the main apparatus (not shown) that heats the aerosolizable material.

In some examples, the filter 109, if present, may be a filter plug, and may be made, for example, from cellulose acetate.

In some cases, the cooling element 107, if present, may comprise a monolithic rod having first and second ends and comprising plural through holes extending between the first and second ends. The through holes may extend substantially parallel to the central longitudinal axis of the rod. The through holes of the cooling element 107 may be arranged generally radially of the element when viewed in lateral cross-section. That is, in an example, the element has internal walls which define the through holes and which have two main configurations, namely radial walls and central walls. The radial walls extend along radii of the cross-section of the element and the central walls are centered on the center of the cross-section of the element. The central walls in one example are circular, though other regular or irregular cross-sectional shapes may be used. Likewise, the cross-section of the element in one example is circular, though other regular or irregular cross-sectional shapes may be used.

In an example, the majority of the through holes have a hexagonal or generally hexagonal cross-sectional shape. In this example, the element has what might be termed a "honeycomb" structure when viewed from one end.

In some cases, the cooling element 107 may comprise a hollow tube which spaces the filter 109, if present, from the very hot part(s) of the main apparatus that heats the aerosolizable material. The cooling element 107 may be formed of for example paper, for example in the form of a spirally wound paper tube, cellulose acetate, cardboard, crimped paper, such as crimped heat resistant paper or crimped parchment paper, and polymeric materials, such as low density polyethylene (LDPE), or some other suitable material.

The cooling element 107, if present, may be substantially incompressible. It may be formed of a ceramic material, or of a polymer, for example a thermoplastic polymer, which may be an extrudable plastics material. In an example, the porosity of the element is in the range 60% to 75%. The porosity in this sense may be a measure of the percentage of the lateral cross-sectional area of the element occupied by the through holes. In an example, the porosity of the element is around 69% to 70%.

Other examples of a cooling element are disclosed in PCT/GB2015/051253, the entirety of which is hereby expressly incorporated by reference, in particular in FIGS. 1 to 8 and the description from page 8, line 11 to page 18, line 16.

In further examples, the cooling element 107 may be formed from a sheet material that is folded, crimped or pleated to form through holes. The sheet material may be made, for example, from metal such as aluminum; polymeric plastics material such as polyethylene, polypropylene, polyethylene terephthalate, or polyvinyl chloride; or paper.

In some examples, the cooling element 107 and the filter 109 may be held together by a wrapper paper (not shown) to form an assembly. The assembly may then be joined to the aerosolizable material by a further wrapper (not shown) which circumscribes the assembly and at least the mouth end of the aerosolizable material to form the aerosol generating article 101. In other examples, the aerosol generating article 101 is formed by wrapping the cooling element 107, the filter 109 and the aerosolizable material 103 effectively in one operation, with no separate tipping paper being provided for the cooling element and/or filter components (if present).

Figure 3:
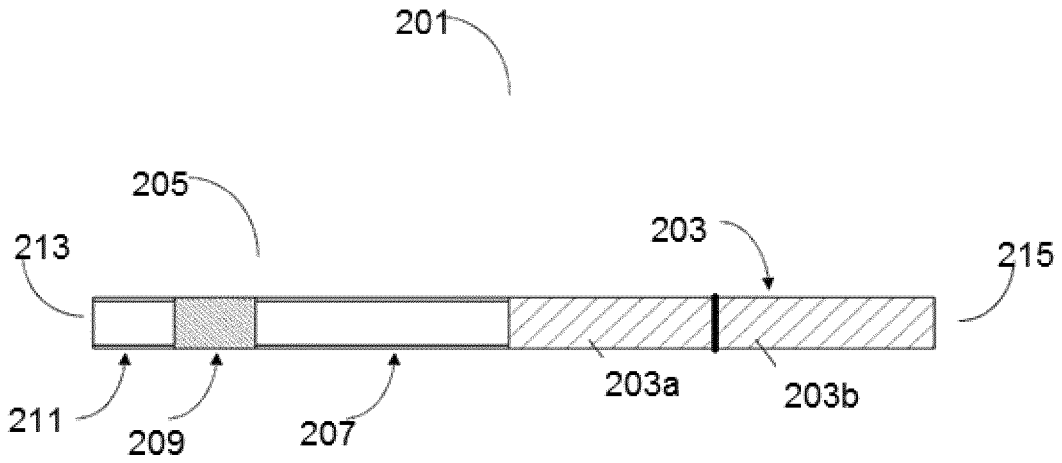
FIG. 3 shows a section view of an example of an aerosol generating article.
Figure 4:
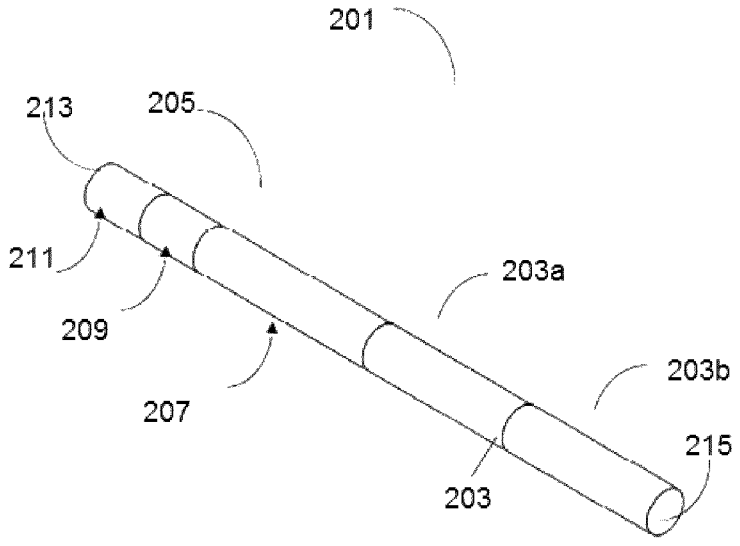
FIG. 4 shows a perspective view of the article of FIG. 3.

Referring now to FIGS. 3 and 4, there are shown a partially cut-away section view and a perspective view of an example of an aerosol generating article 201. The article 201 is adapted for use with device having a power source and a heater. The article 201 of this embodiment is particularly suitable for use with the device 1 shown in FIGS. 7 to 9, described below. In use, the article 201 may be removably inserted into the device shown in FIG. 7 at an insertion point 20 of the device 1.

The article 201 of one example is in the form of a substantially cylindrical rod that includes a body of aerosolizable material 203 and a filter assembly 205 in the form of a rod. The aerosolizable material has two sections 203*a*, 203*b* which correspond to the sections 103*a*, 103*b* illustrated in FIG. 1. In some cases, the two sections 203*a*, 203*b* of aerosolizable material 203 may be joined together by annular tipping paper (not shown), which is located substantially around the circumference of the aerosolizable material 203.

The filter assembly 205 includes three segments, a cooling segment 207, a filter segment 209 and a mouth end segment 211. The article 201 has a first end 213, also known as a mouth end or a proximal end and a second end 215, also known as a distal end. The body of aerosolizable material 203 is located towards the distal end 215 of the article 201. In one example, the cooling segment 207 is located adjacent the body of aerosolizable material 203 between the body of aerosolizable material 203 and the filter segment 209, such that the cooling segment 207 is in an abutting relationship with the aerosolizable material 203 and the filter segment 209. In other examples, there may be a separation between the body of aerosolizable material 203 and the cooling segment 207 and between the body of aerosolizable material 203 and the filter segment 209. The filter segment 209 is located in between the cooling segment 207 and the mouth end segment 211. The mouth end segment 211 is located towards the proximal end 213 of the article 201, adjacent the filter segment 209. In one example, the filter segment 209 is in an abutting relationship with the mouth end segment 211. In one embodiment, the total length of the filter assembly 205 is between 37 mm and 45 mm, suitably 41 mm.

In some examples, the body of aerosolizable material 203 is between 30 mm and 54 mm in length, suitably between 36 mm and 48 mm in length. The sections of aerosolizable material may be the same length as each other (i.e. half of the total length in embodiments with two sections of aerosolizable material 203).

In one example, the total length of the article 201 is between 71 mm and 95 mm, suitably between 79 mm and 87 mm, suitably about 83 mm.

An axial end of the body of aerosolizable material 203 is visible at the distal end 215 of the article 201. However, in other embodiments, the distal end 215 of the article 201 may comprise an end member (not shown) covering the axial end of the body of aerosolizable material 203.

The body of aerosolizable material 203 is joined to the filter assembly 205 by annular tipping paper (not shown), which is located substantially around the circumference of the filter assembly 205 to surround the filter assembly 205 and extends partially along the length of the body of aerosolizable material 203. In one example, the tipping paper is made of 58 GSM standard tipping base paper. In one example, the tipping paper has a length of between 42 mm and 50 mm, suitably about 46 mm.

In some cases, the same tipping paper may be used to join the sections 203*a*, 203*b* of aerosolizable material 203 and the filter assembly 205.

In one example, the cooling segment 207 is an annular tube and is located around and defines an air gap within the cooling segment. The air gap provides a chamber for heated volatilized components generated from the body of aerosolizable material 203 to flow. The cooling segment 207 is hollow to provide a chamber for aerosol accumulation yet rigid enough to withstand axial compressive forces and bending moments that might arise during manufacture and whilst the article 201 is in use during insertion into the device 1. In one example, the thickness of the wall of the cooling segment 207 is approximately 0.29 mm.

The cooling segment 207 provides a physical displacement between the aerosolizable material 203 and the filter segment 209. The physical displacement provided by the cooling segment 207 will provide a thermal gradient across the length of the cooling segment 207. In one example the cooling segment 207 is configured to provide a temperature differential of at least 40 degrees Celsius between a heated volatilized component entering a first end of the cooling segment 207 and a heated volatilized component exiting a second end of the cooling segment 207. In one example the cooling segment 207 is configured to provide a temperature differential of at least 60 degrees Celsius between a heated volatilized component entering a first end of the cooling segment 207 and a heated volatilized component exiting a second end of the cooling segment 207. This temperature differential across the length of the cooling element 207 protects the temperature sensitive filter segment 209 from the high temperatures of the aerosolizable material 203 when it is heated by the heating arrangement of the device 1. If the physical displacement was not provided between the filter segment 209 and the body of aerosolizable material 203 and the heating elements of the device 1, then the temperature sensitive filter segment may 209 become damaged in use, so it would not perform its required functions as effectively.

In one example the length of the cooling segment 207 is at least 15 mm. In one example, the length of the cooling segment 207 is between 20 mm and 30 mm, suitably 23 mm to 27 mm or 25 mm to 27 mm, most suitably about 25 mm.

The cooling segment 207 may be made of paper, which means that it comprises a material that does not generate compounds of concern, for example, toxic compounds when in use adjacent to the heater arrangement of the device 1. In one example, the cooling segment 207 is manufactured from a spirally wound paper tube which provides a hollow internal chamber yet maintains mechanical rigidity. Spirally wound paper tubes are able to meet the tight dimensional accuracy requirements of high-speed manufacturing processes with respect to tube length, outer diameter, roundness and straightness.

In another example, the cooling segment 207 is a recess created from stiff plug wrap or tipping paper. The stiff plug wrap or tipping paper is manufactured to have a rigidity that is sufficient to withstand the axial compressive forces and bending moments that might arise during manufacture and whilst the article 201 is in use during insertion into the device 1.

The filter segment 209 may be formed of any filter material sufficient to remove one or more volatilized compounds from heated volatilized components from the aerosolizable material. In one example the filter segment 209 is made of a mono-acetate material, such as cellulose acetate. The filter segment 209 provides cooling and irritation-reduction from the heated volatilized components without depleting the quantity of the heated volatilized components to an unsatisfactory level for a user.

The density of the cellulose acetate tow material of the filter segment 209 controls the pressure drop across the filter segment 209, which in turn controls the draw resistance of the article 1. Therefore the selection of the material of the filter segment 209 is important in controlling the resistance to draw of the article 201. In addition, the filter segment performs a filtration function in the article 201.

In one example, the filter segment 209 is made of a 8Y15 grade of filter tow material, which provides a filtration effect on the heated volatilized material, whilst also reducing the size of condensed aerosol droplets which result from the heated volatilized material which consequentially reduces the irritation and throat impact of the heated volatilized material to satisfactory levels.

The presence of the filter segment 209 provides an insulating effect by providing further cooling to the heated volatilized components that exit the cooling segment 207. This further cooling effect reduces the contact temperature of the user's lips on the surface of the filter segment 209.

One or more flavors may be added to the filter segment 209 in the form of either direct injection of flavored liquids into the filter segment 209 or by embedding or arranging one or more flavored breakable capsules or other flavor carriers within the cellulose acetate tow of the filter segment 209.

In one example, the filter segment 209 is between 6 mm to 10 mm in length, suitably about 8 mm.

The mouth end segment 211 is an annular tube and is located around and defines an air gap within the mouth end segment 211. The air gap provides a chamber for heated volatilized components that flow from the filter segment 209. The mouth end segment 211 is hollow to provide a chamber for aerosol accumulation yet rigid enough to withstand axial compressive forces and bending moments that might arise during manufacture and whilst the article is in use during insertion into the device 1. In one example, the thickness of the wall of the mouth end segment 211 is approximately 0.29 mm.

In one example, the length of the mouth end segment 211 is between 6 mm to 10 mm and suitably about 8 mm.

The mouth end segment 211 may be manufactured from a spirally wound paper tube which provides a hollow internal chamber yet maintains critical mechanical rigidity. Spirally wound paper tubes are able to meet the tight dimensional accuracy requirements of high-speed manufacturing processes with respect to tube length, outer diameter, roundness and straightness.

The mouth end segment 211 provides the function of preventing any liquid condensate that accumulates at the exit of the filter segment 209 from coming into direct contact with a user.

It should be appreciated that, in one example, the mouth end segment 211 and the cooling segment 207 may be formed of a single tube and the filter segment 209 is located within that tube separating the mouth end segment 211 and the cooling segment 207.

Figure 5:
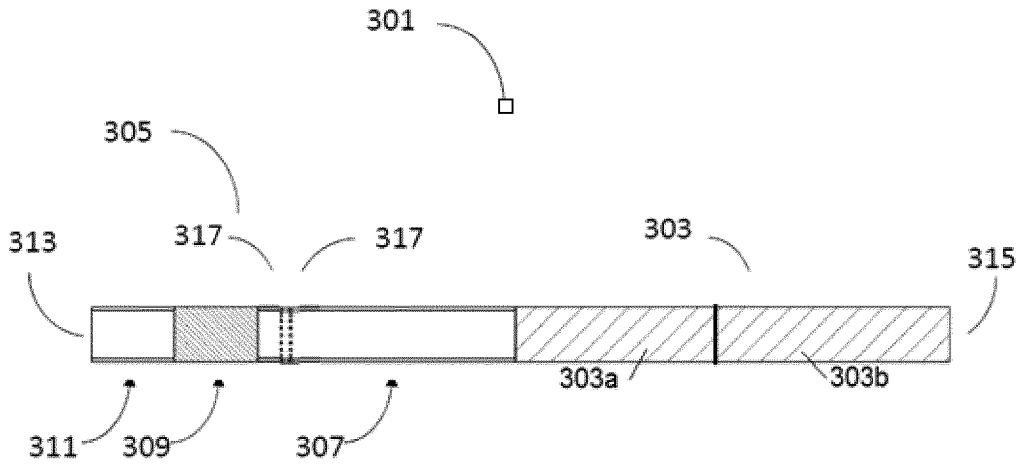
FIG. 5 shows a sectional elevation of an example of an aerosol generating article.
Figure 6:
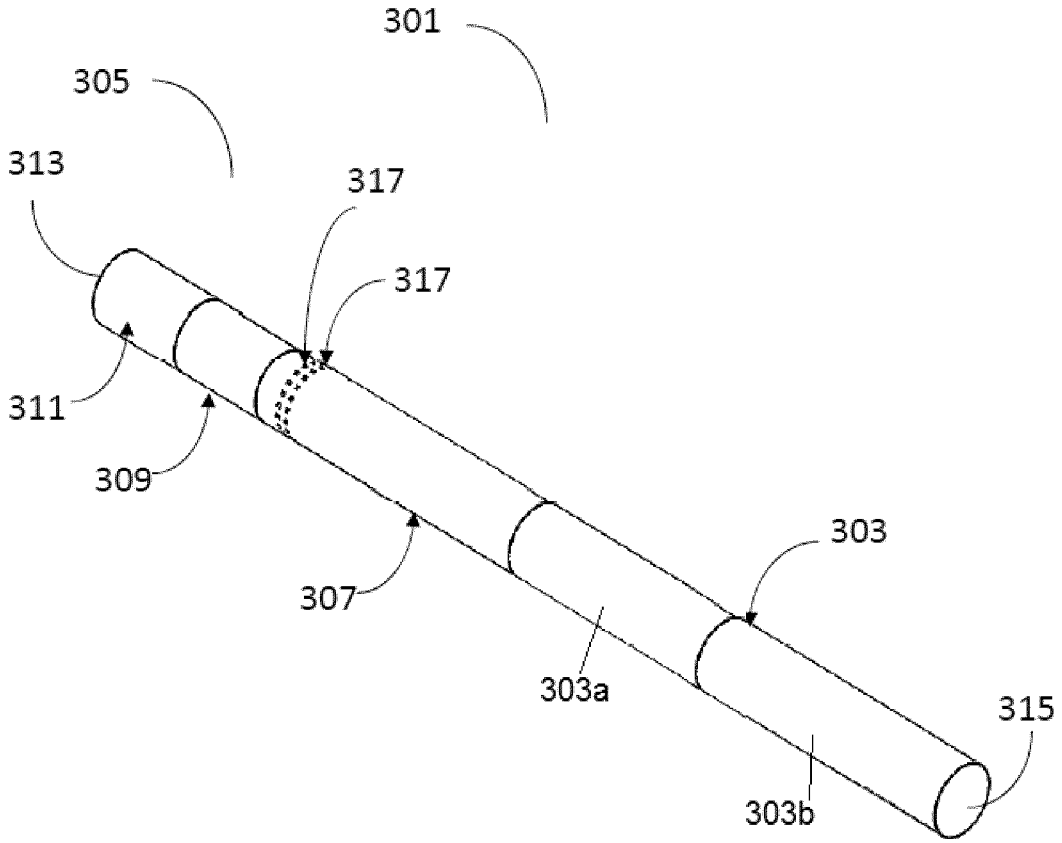
FIG. 6 shows a perspective view of the article of FIG. 5.

Referring now to FIGS. 5 and 6, there are shown a partially cut-away section and perspective views of an example of an article 301 according to an embodiment of the disclosure. The reference signs shown in FIGS. 5 and 6 are equivalent to the reference signs shown in FIGS. 3 and 4, but with an increment of 100.

In the example of the article 301 shown in FIGS. 5 and 6, a ventilation region 317 is provided in the article 301 to enable air to flow into the interior of the article 301 from the exterior of the article 301. In one example the ventilation region 317 takes the form of one or more ventilation holes 317 formed through the outer layer of the article 301. The ventilation holes may be located in the cooling segment 307 to aid with the cooling of the article 301. In one example, the ventilation region 317 comprises one or more rows of holes, and in some case, each row of holes is arranged circumferentially around the article 301 in a cross-section that is substantially perpendicular to a longitudinal axis of the article 301.

In one example, there are between one to four rows of ventilation holes to provide ventilation for the article 301. Each row of ventilation holes may have between 12 to 36 ventilation holes 317. The ventilation holes 317 may, for example, be between 100 to 500 μm in diameter. In one example, an axial separation between rows of ventilation holes 317 is between 0.25 mm and 0.75 mm, suitably 0.5 mm.

In one example, the ventilation holes 317 are of uniform size. In another example, the ventilation holes 317 vary in size. The ventilation holes can be made using any suitable technique, for example, one or more of the following techniques: laser technology, mechanical perforation of the cooling segment 307 or pre-perforation of the cooling segment 307 before it is formed into the article 301. The ventilation holes 317 are positioned so as to provide effective cooling to the article 301.

In one example, the rows of ventilation holes 317 are located at least 11 mm from the proximal end 313 of the article, suitably between 17 mm and 20 mm from the proximal end 313 of the article 301. The location of the ventilation holes 317 is positioned such that user does not block the ventilation holes 317 when the article 301 is in use.

Figure 8:
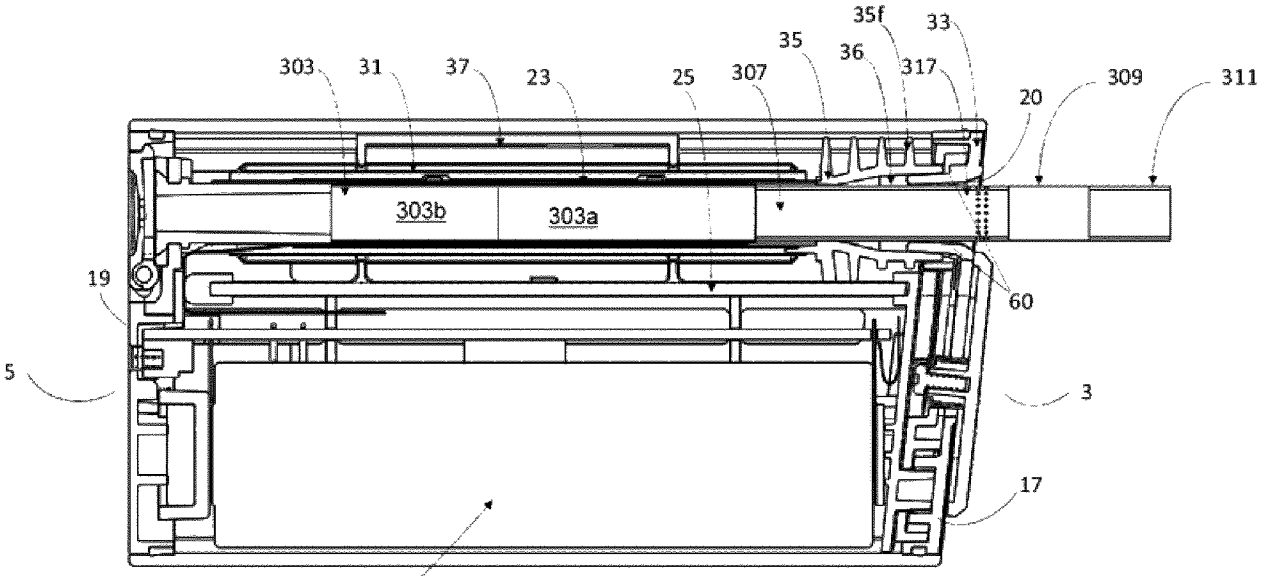
FIG. 8 shows a section view of an example of an aerosol generating system.
Figure 9:
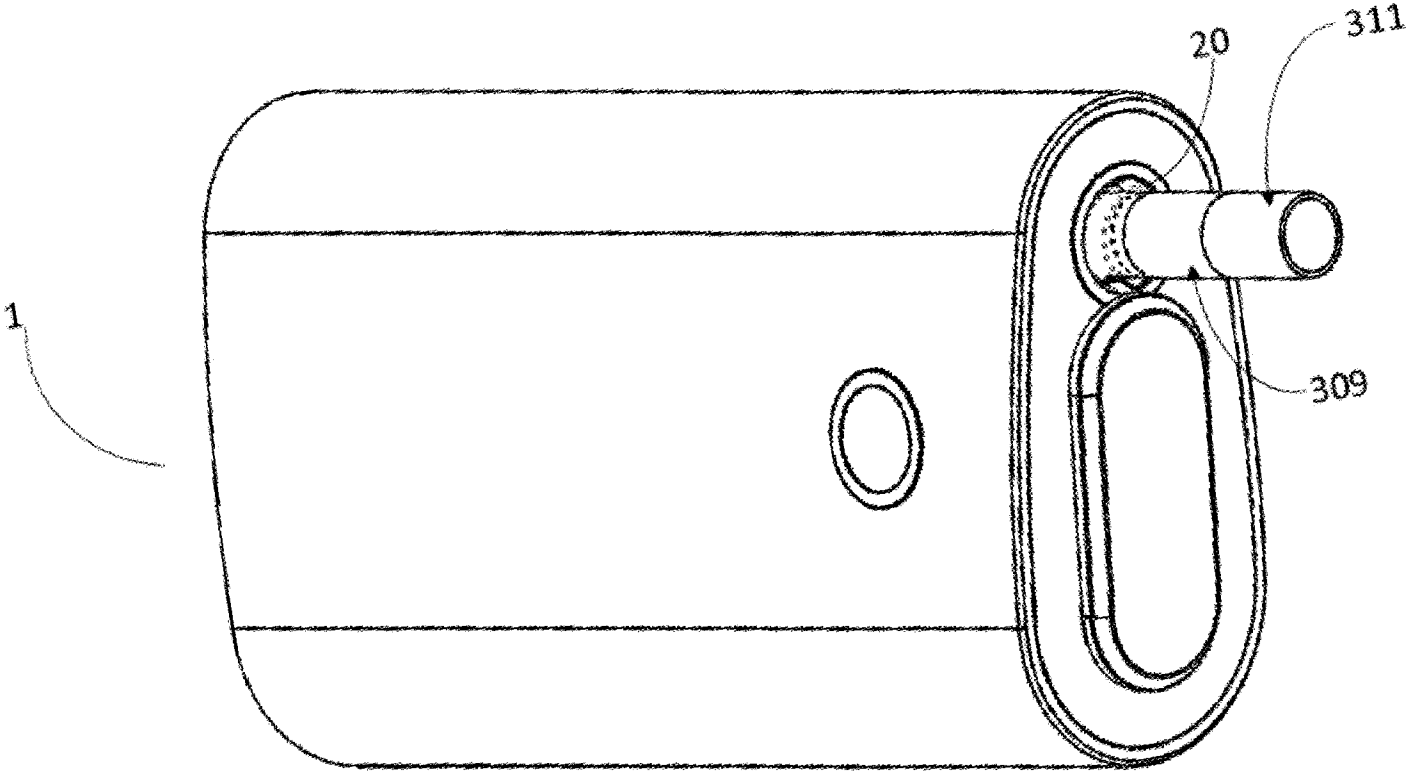
FIG. 9 shows a perspective view of an example of an aerosol generating system.

Providing the rows of ventilation holes between 17 mm and 20 mm from the proximal end 313 of the article 301 enables the ventilation holes 317 to be located outside of the device 1, when the article 301 is fully inserted in the device 1, as can be seen in FIGS. 8 and 9. By locating the ventilation holes outside of the device, non-heated air is able to enter the article 301 through the ventilation holes from outside the device 1 to aid with the cooling of the article 301.

The length of the cooling segment 307 is such that the cooling segment 307 will be partially inserted into the device 1, when the article 301 is fully inserted into the device 1. The length of the cooling segment 307 provides a first function of providing a physical gap between the heater arrangement of the device 1 and the heat sensitive filter arrangement 309, and a second function of enabling the ventilation holes 317 to be located in the cooling segment, whilst also being located outside of the device 1, when the article 301 is fully inserted into the device 1. As can be seen from FIGS. 8 and 9, the majority of the cooling element 307 is located within the device 1. However, there is a portion of the cooling element 307 that extends out of the device 1. It is in this portion of the cooling element 307 that extends out of the device 1 in which the ventilation holes 317 are located.

Figure 7:
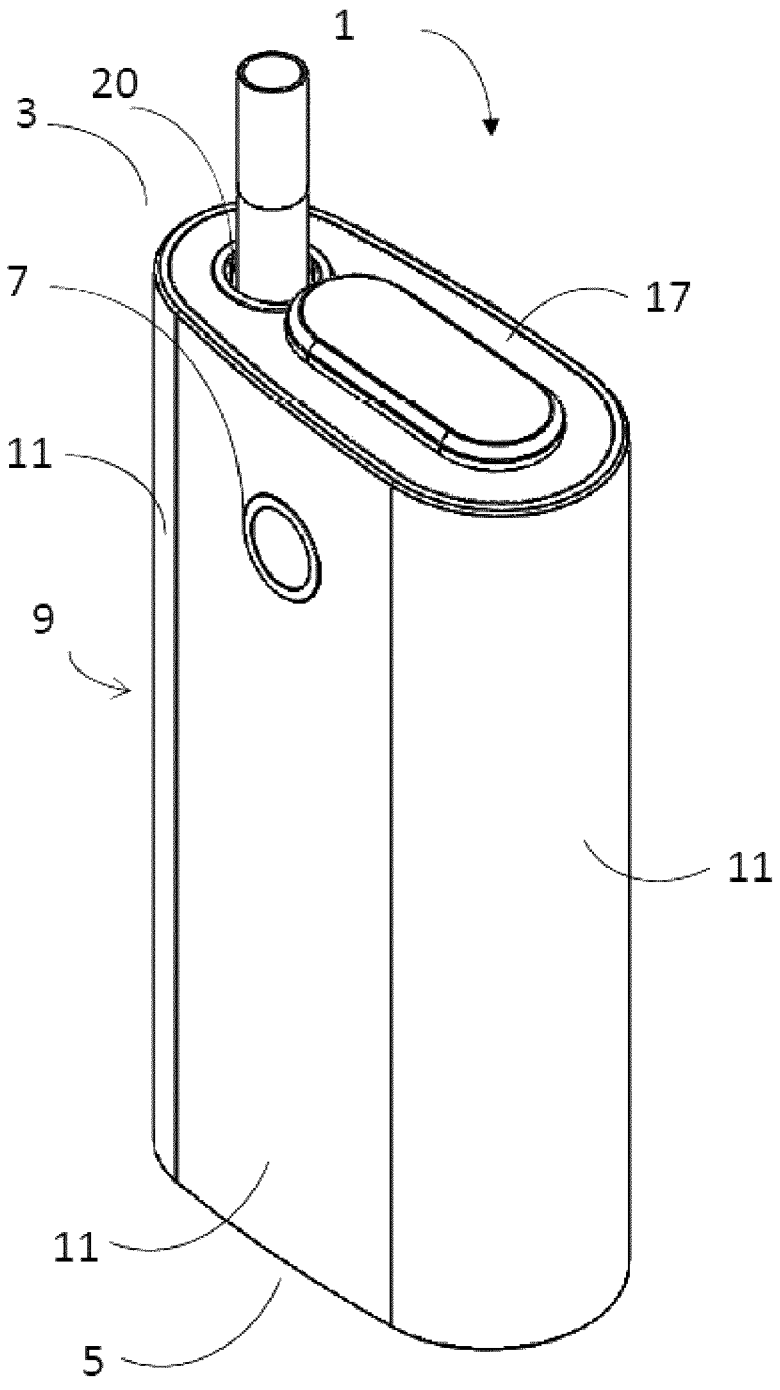
FIG. 7 shows a perspective view of an example of an aerosol generating system.

Referring now to FIGS. 7 to 9 in more detail, there is shown an example of a device 1 arranged to heat aerosolizable material to volatilize at least one component of the said aerosolizable material, typically to form an aerosol which can be inhaled. The device 1 is a heating device 1 which releases compounds by heating, but not burning, the aerosolizable material.

A first end 3 is sometimes referred to herein as the mouth or proximal end 3 of the device 1 and a second end 5 is sometimes referred to herein as the distal end 5 of the device 1. The device 1 has an on/off button 7 to allow the device 1 as a whole to be switched on and off as desired by a user.

The device 1 comprises a housing 9 for locating and protecting various internal components of the device 1. In the example shown, the housing 9 comprises a uni-body sleeve 11 that encompasses the perimeter of the device 1, capped with a top panel 17 which defines generally the 'top' of the device 1 and a bottom panel 19 which defines generally the 'bottom' of the device 1. In another example the housing comprises a front panel, a rear panel and a pair of opposite side panels in addition to the top panel 17 and the bottom panel 19.

The top panel 17 and/or the bottom panel 19 may be removably fixed to the uni-body sleeve 11, to permit easy access to the interior of the device 1, or may be "permanently" fixed to the uni-body sleeve 11, for example to deter a user from accessing the interior of the device 1. In an example, the panels 17 and 19 are made of a plastics material, including for example glass-filled nylon formed by injection molding, and the uni-body sleeve 11 is made of aluminum, though other materials and other manufacturing processes may be used.

The top panel 17 of the device 1 has an opening 20 at the mouth end 3 of the device 1 through which, in use, the article 201, 301 including aerosolizable material may be inserted into the device 1 and removed from the device 1 by a user.

The housing 9 has located or fixed therein a heater arrangement 23, control circuitry 25 and a power source 27. In this example, the heater arrangement 23, the control circuitry 25 and the power source 27 are laterally adjacent (that is, adjacent when viewed from an end), with the control circuitry 25 being located generally between the heater arrangement 23 and the power source 27, though other locations are possible.

The control circuitry 25 may include a controller, such as a microprocessor arrangement, configured and arranged to control the heating of the aerosolizable material in the consumable article 201, 301 as discussed further below.

The power source 27 may be for example a battery, which may be a rechargeable battery or a non-rechargeable battery. Examples of suitable batteries include for example a lithium-ion battery, a nickel battery (such as a nickel-cadmium battery), an alkaline battery and/or the like. The battery 27 is electrically coupled to the heater arrangement 23 to supply electrical power when required and under control of the control circuitry 25 to heat the aerosolizable material in the article (as discussed, to volatilize the aerosolizable material without causing the aerosolizable material to burn).

An advantage of locating the power source 27 laterally adjacent to the heater arrangement 23 is that a physically large power source 25 may be used without causing the device 1 as a whole to be unduly lengthy. As will be understood, in general a physically large power source 25 has a higher capacity (that is, the total electrical energy that can be supplied, often measured in Amp-hours or the like) and thus the battery life for the device 1 can be longer.

In one example, the heater arrangement 23 is generally in the form of a hollow cylindrical tube, having a hollow interior heating chamber 29 into which the article 201, 301 comprising the aerosolizable material is inserted for heating in use. Different arrangements for the heater arrangement 23 are possible. For example, the heater arrangement 23 may comprise plural heating elements aligned along the longitudinal axis of the heater arrangement 23. Each heating element may be annular or tubular, or at least part-annular or part-tubular around its circumference. In an example, each heating element may be a thin film heater. In another example, each heating element may be made of a ceramics material. Examples of suitable ceramics materials include alumina and aluminum nitride and silicon nitride ceramics, which may be laminated and sintered. Other heating arrangements are possible, including for example inductive heating, infrared heater elements, which heat by emitting infrared radiation, or resistive heating elements formed by for example a resistive electrical winding.

In one particular example, the heater arrangement 23 is supported by a stainless-steel support tube and comprises a polyimide heating element. The heater arrangement 23 is dimensioned so that substantially the whole of the body of aerosolizable material 203, 303 of the article 201, 301 is inserted into the heater arrangement 23 when the article 201, 301 is inserted into the device 1.

The heating elements are disposed so that each heating element respectively heats a section of the aerosolizable material.

The heater arrangement 23 in this example is surrounded along at least part of its length by a thermal insulator 31. The insulator 31 helps to reduce heat passing from the heater arrangement 23 to the exterior of the device 1. This helps to keep down the power requirements for the heater arrangement 23 as it reduces heat losses generally. The insulator 31 also helps to keep the exterior of the device 1 cool during operation of the heater arrangement 23. In one example, the insulator 31 may be a double-walled sleeve which provides a low pressure region between the two walls of the sleeve. That is, the insulator 31 may be for example a "vacuum" tube, i.e. a tube that has been at least partially evacuated so as to minimize heat transfer by conduction and/or convection. Other arrangements for the insulator 31 are possible, including using heat insulating materials, including for example a suitable foam-type material, in addition to or instead of a double-walled sleeve.

The housing 9 may further comprises various internal support structures 37 for supporting all internal components, as well as the heating arrangement 23.

The device 1 further comprises a collar 33 which extends around and projects from the opening 20 into the interior of the housing 9 and a generally tubular chamber 35 which is located between the collar 33 and one end of the vacuum sleeve 31. The chamber 35 further comprises a cooling structure 35*f*, which in this example, comprises a plurality of cooling fins 35*f* spaced apart along the outer surface of the chamber 35, and each arranged circumferentially around outer surface of the chamber 35. There is an air gap 36 between the hollow chamber 35 and the article 201, 301 when it is inserted in the device 1 over at least part of the length of the hollow chamber 35. The air gap 36 is around all of the circumference of the article 201, 301 over at least part of the cooling segment 307.

The collar 33 comprises a plurality of ridges 60 arranged circumferentially around the periphery of the opening 20 and which project into the opening 20. The ridges 60 take up space within the opening 20 such that the open span of the opening 20 at the locations of the ridges 60 is less than the open span of the opening 20 at the locations without the ridges 60. The ridges 60 are configured to engage with an article 201, 301 inserted into the device to assist in securing it within the device 1. Open spaces (not shown in the Figures) defined by adjacent pairs of ridges 60 and the article 201, 301 form ventilation paths around the exterior of the article 201, 301. These ventilation paths 1 allow hot vapors that have escaped from the article 201, 301 to exit the device 1 and allow cooling air to flow into the device 1 around the article 201, 301 in the air gap 36.

In operation, the article 201, 301 is removably inserted into an insertion point 20 of the device 1, as shown in FIGS. 7 to 9. Referring particularly to FIG. 8, in one example, the body of aerosolizable material 203, 303, which is located towards the distal end 215, 315 of the article 201, 301, is entirely received within the heater arrangement 23 of the device 1. The proximal end 213, 313 of the article 201, 301 extends from the device 1 and acts as a mouthpiece assembly for a user.

In operation, the heater arrangement 23 will heat the consumable article 201, 301 to volatilize at least one component of the aerosolizable material from the first section of aerosolizable material 203*a*, 303*a*. The button 7 can be used to selectively actuate the second heater, to volatilize at least one component of the aerosolizable material from the second section of aerosolizable material 203*b*, 303*b*, if desired. The button 7 is programmed to provide different responses in response to different user input (e.g. length of press, pressure applied), so it can operate as both the on/off switch, and the actuating switch for the second heater.

The primary flow path for the heated volatilized components from the body of aerosolizable material 203, 303 is axially through the article 201, 301, through the chamber inside the cooling segment 207, 307, through the filter segment 209, 309, through the mouth end segment 211, 313 to the user. In one example, the temperature of the heated volatilized components that are generated from the body of aerosolizable material is between 60° C. and 250° C., which may be above the acceptable inhalation temperature for a user. As the heated volatilized component travels through the cooling segment 207, 307, it will cool and some volatilized components will condense on the inner surface of the cooling segment 207, 307.

In the examples of the article 301 shown in FIGS. 5 and 6, cool air will be able to enter the cooling segment 307 via the ventilation holes 317 formed in the cooling segment 307. This cool air will mix with the heated volatilized components to provide additional cooling to the heated volatilized components.

Figure 10:
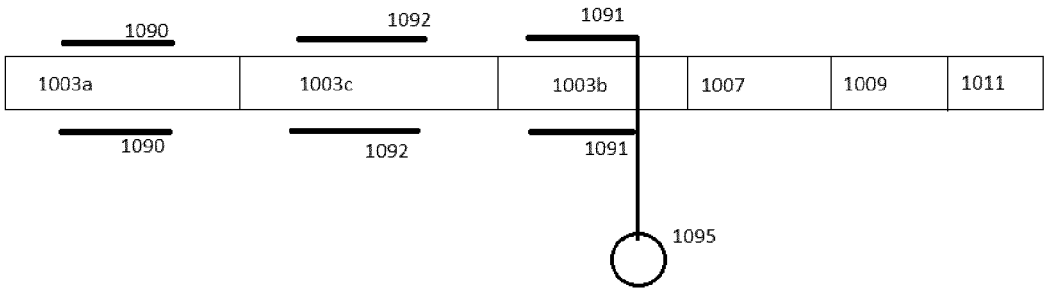
FIG. 10 shows a schematic sectional illustration of an aerosol generating system.

FIG. 10 shows a sectional schematic illustration of an aerosol generating system according to the disclosure. A rod-shaped aerosol generating article is shown, having from one end to the other, a mouth-end segment 1011, a filter segment 1009 adjacent to the mouth-end segment 1011, a cooling segment 1007 adjacent to the filter segment 1009, a second section 1003*b* of aerosolizable material adjacent to the cooling segment, a third section 1003*c* of aerosolizable material adjacent to the second section 1003*b*, and a first section 1003*a* of aerosolizable material adjacent to the third section 1003*c*. Three cylindrical heaters 1090, 1091, 1092 are arranged to heat the respective sections 1003*a*-*c*. The second heater 1091 which heats the second section 1003*b* is connected to a user input mechanism 1095 which allows selective actuation of the second heater 1091 to a temperature that causes volatilization of aerosolizable components present in the second section 1003*b*. The first 1090 and third heaters 1092 are programmed to heat the respective sections of aerosolizable material according to a pre-programmed heating profile, such as that disclosed in PCT/EP2017/068804, the contents of which are incorporated herein by reference in their entirety.

In some embodiments, the first 1003*a* and third 1003*c* sections have the same composition. In some cases, they have different compositions. In some cases, they have the same composition and comprise and tobacco material but no encapsulated flavorant. In some embodiments, the second section 1003*b* comprises encapsulated flavorant and no tobacco material. In some cases, one or more of these sections comprises encapsulated flavorant.

As will be apparent from the preceding description, the terms "first" and "second" and the like as used throughout this specification do not impart any order or sequence. For the avoidance of doubt, these terms are only used to differentiate between the respective sections/heaters etc and do not indicate that they are provided in the order "first, second, third etc.".

The above examples are to be understood as illustrative examples of the disclosure. It is to be understood that any feature described in relation to any one example may be used alone, or in combination with other features described, and may also be used in combination with one or more features of any other of the examples, or any combination of any other of the examples. Furthermore, equivalents and modifications not described above may also be employed without departing from the scope of the invention, which is defined in the accompanying claims.

The invention claimed is:

1. An aerosol generating system comprising:

an aerosolizable material, wherein the aerosolizable material comprises at least two sections, wherein at least one of the at least two sections comprises a tobacco material and wherein the at least two sections of the aerosolizable material have different compositions; and at least a first heater and a second heater, wherein the first heater and the second heater are arranged to respectively heat the at least two sections of the aerosolizable material, wherein the aerosol generating system is configured such that during a session of use by a user, after initiation of heating of a first of the at least two sections by the first heater, the second heater is selectively actuatable by the user to heat a second of the at least two sections to a temperature which causes volatilization of aerosolizable components of the second section, and wherein the system comprises a user input mechanism, wherein the user input mechanism is operably by the user in use to cause actuation of the second heater to provide user control over the volatilization of the components of the second section to facilitate user control over the composition of a generated aerosol.

2. The aerosol generating system according to claim 1, wherein the second heater is configured such that during a period when the second heater is not actuated to heat the second section of the aerosolizable material to a temperature which volatilizes components thereof, the second heater is heated to an intermediate temperature, wherein the intermediate temperature is higher than room temperature and lower than a temperature required to volatilize components of the second section.

3. The aerosol generating system according to claim 1, wherein the aerosol generating system is configured such that during heating of the first section by the first heater, the second heater is selectively actuatable to heat the second section to the temperature which causes volatilization of aerosolizable components of the second section.

4. The aerosol generating system according to claim 1, wherein at least one of the at least two sections comprises an un-encapsulated aerosol modifying agent.

5. The aerosol generating system according to claim 1, wherein the aerosolizable material has a rod shape, and the at least two sections are arranged coaxially along a longitudinal axis of the rod shape of the aerosolizable material.

6. The aerosol generating system according to claim 1, comprising at least a third heater.

7. The aerosol generating system according to claim 6, wherein:

the third heater is configured to heat the same section of aerosolizable material as the first section, or the third heater is configured to heat a third section of the aerosolizable material; and wherein a heating profile of the third heater is programmed into the aerosol generating system and is not selectively actuatable by a user.

8. The aerosol generating system according to claim 1, wherein at least one other section of the at least two sections comprises an aerosol modifying agent.

9. The aerosol generating system according to claim 8, wherein the first section comprises the tobacco material and the second section comprises the aerosol modifying agent.

10. The aerosol generating system according to claim 8, wherein the aerosol modifying agent is encapsulated and is releasable on heating to a threshold release temperature.

11. The aerosol generating system according to claim 8, wherein the at least one other section does not include any tobacco material.

12. The aerosol generating system according to claim 1, wherein the at least one other section comprises tobacco material.

13. The aerosol generating system according to claim 8, wherein the aerosol modifying agent comprises a flavorant.

14. The aerosol generating system according to claim 13, wherein the flavorant comprises menthol.

15. The aerosol generating system according to claim 1, comprising an aerosol generating article, the aerosol generating article comprising:

the aerosolizable material; and at least one of a cooling element or a filter, wherein the aerosolizable material comprises at least two sections having different compositions, wherein at least a first one of the at least two sections comprises a tobacco material and at least a second one of the at least two sections comprises an aerosol modifying agent.

16. The aerosol generating system according to claim 15, wherein the second one of the at least two sections of the aerosolizable material is provided between the first one of the at least two sections of the aerosolizable material and the at least one of the cooling element or the filter.

17. The aerosol generating system according to claim 15, wherein the first one of the at least two sections of the aerosolizable material is provided between the second one of the least two sections of the aerosolizable material and the at least one of the cooling element or the filter.

18. The aerosol generating system according to claim 15, wherein the first one of the at least two sections comprises the tobacco material and the second one of the at least two sections comprises the aerosol modifying agent.

19. The aerosol generating system according to claim 15, wherein the second of the at least two sections comprises the aerosol modifying agent in an amount of 0.1 wt % to 99 wt % by weight of the first of the at least two sections.

20. The aerosol generating system according to claim 15, wherein at least one of the first or the second of the at least two sections comprises an un-encapsulated aerosol modifying agent.

21. The aerosol generating system according to claim 15, wherein at least one of the first or the second of the at least two sections does not include any un-encapsulated aerosol modifying agent.

22. The aerosol generating system according to claim 15 wherein the second of the at least two sections does not include any tobacco material.

23. The aerosol generating system according to claim 15 wherein the second of the at least two sections comprises tobacco material.

24. The aerosol generating system according to claim 15, wherein the first one of the at least two sections does not include any aerosol modifying agent of the same type as present in the second of the at least two sections.

25. The aerosol generating system according to claim 10, wherein the aerosol generating article is elongate, and the at least two sections are arranged coaxially along a longitudinal axis of the aerosol generating article.

26. The aerosol generating system according to claim 15, wherein the aerosol modifying agent is encapsulated and is releasable on heating to at least a threshold release temperature.

27. The aerosol generating system according to claim 26, wherein the threshold release temperature is at least 50° C., at least 100° C., or at least 150° C.

28. The aerosol generating system according to claim 26, wherein the threshold release temperature is less than about 300° C., 250° C. or 200° C.

29. The aerosol generating system according to claim 26, comprising an amorphous solid which encapsulates the aerosol modifying agent.

30. The aerosol generating system according to claim 23, comprising a film, wherein the film comprises the amorphous solid.

31. The aerosol generating system according to claim 10, wherein the aerosol modifying agent comprises a flavorant.

32. The aerosol generating system according to claim 31, wherein the flavorant comprises menthol.

33. The aerosol generating system according to claim 1, wherein the user input mechanism is a button.

34. The aerosol generating system according to claim 3, wherein the button selectively actuates the second heater, to volatize at least one component of the aerosolizable material from the second section of aerosolizable material.

35. The aerosol generating system according to claim 33, wherein the button is programmed to provide different responses in response to different user input, so it can operate as both the on/off switch, and the actuating switch for the second heater.

36. An aerosol generating system according to claim 1, comprising an aerosol generating device, the aerosol generating device comprising:

at least the first heater and the second heater, wherein the first heater and the second heater are arranged to respectively heat the first section and the second section of the aerosolizable material in use, wherein the aerosol generating device is configured such that during a session of use by a user, after initiation of heating the first heater to a temperature which causes volatilization of aerosolizable components of the first section of aerosolizable material, the second heater is selectively actuatable by the user to heat the second section to a temperature which causes volatilization of aerosolizable components of the second section of aerosolizable material.

37. The aerosol generating system according to claim 36, wherein the second heater is configured such that during a period when the second heater is not actuated to heat the second section of the aerosolizable material to a temperature which volatilizes components thereof, the second heater is heated to an intermediate temperature, wherein the intermediate temperature is higher than room temperature and lower than a temperature required to volatilize components of the second section.

38. The aerosol generating system according to claim 36, wherein the aerosol generating device is configured such that during heating of the first section by the first heater, the second heater is selectively actuatable to heat the second section to the temperature which causes volatilization of aerosolizable components of the second section.

39. The aerosol generating system according to claim 36, wherein the aerosol generating device comprises a third heater, and wherein a heating profile of the third heater is programmed into the aerosol generating device and is not selectively actuatable by a user.

40. The aerosol generating system according to claim 36, wherein the second heater is closer to a mouth end of the aerosol generating device than the first heater.

41. The aerosol generating system according to claim 36, comprising a chamber for retaining the aerosolizable material in use.

42. The aerosol generating system according to claim 41, wherein at least one of the first heater or the second heater is tubular and surrounds the chamber for retaining the aerosolizable material in use.

43. The aerosol generating system according to claim 42, wherein each of the first heater and the second heater is tubular and surrounds the chamber for retaining the aerosolizable material in use.

44. The aerosol generating system according to claim 36, wherein the user input mechanism is a button.

45. The aerosol generating system according to claim 10, wherein the button selectively actuates the second heater, to volatize at least one component of the aerosolizable material from the second section of aerosolizable material.

46. The aerosol generating system according to claim 44, wherein the button is programmed to provide different responses in response to different user input, so it can operate as both the on/off switch, and the actuating switch for the second heater.

* * * * *